US011952875B2

(12) United States Patent
Cheah et al.

(10) Patent No.: US 11,952,875 B2
(45) Date of Patent: Apr. 9, 2024

(54) NON-AXISYMMETRIC HUB AND SHROUD PROFILE FOR ELECTRIC SUBMERSIBLE PUMP STAGE

(71) Applicant: Schlumberger Technology Corporation, Sugar Land, TX (US)

(72) Inventors: Kean Wee Cheah, Singapore (SG); David Milton Eslinger, Collinsville, OK (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 63 days.

(21) Appl. No.: 17/755,175

(22) PCT Filed: Oct. 23, 2020

(86) PCT No.: PCT/US2020/057013
§ 371 (c)(1),
(2) Date: Apr. 22, 2022

(87) PCT Pub. No.: WO2021/081299
PCT Pub. Date: Apr. 29, 2021

(65) Prior Publication Data

US 2022/0397024 A1 Dec. 15, 2022

Related U.S. Application Data

(60) Provisional application No. 62/925,788, filed on Oct. 25, 2019.

(51) Int. Cl.
*F04D 13/10* (2006.01)
*E21B 43/12* (2006.01)
*F04D 29/22* (2006.01)
*F04D 29/44* (2006.01)

(52) U.S. Cl.
CPC ..... *E21B 43/128* (2013.01); *F04D 13/10* (2013.01); *F04D 29/2216* (2013.01); *F04D 29/448* (2013.01)

(58) Field of Classification Search
CPC .. F05D 2230/21; F01D 5/143; F04D 29/2216; F04D 29/448
See application file for complete search history.

(56) References Cited

U.S. PATENT DOCUMENTS 5,545,008 A 8/1996 Guelich
6,019,927 A * 2/2000 Galliger ..... B22C 7/02 264/225
6,305,458 B1 * 10/2001 Gligor ..... B22C 9/22 164/28

(Continued)

FOREIGN PATENT DOCUMENTS

JP 2004027893 A 1/2004

OTHER PUBLICATIONS

International Search Report and Written Opinion issued in PCT Application PCT/US2020/057013, dated Jan. 29, 2021 (10 pages).

*Primary Examiner* — Eldon T Brockman
(74) *Attorney, Agent, or Firm* — Jeffrey D. Frantz

(57) ABSTRACT

Electric submersible pump and other centrifugal pump stages having non-axisymmetric components and passage contours are disclosed. Such a component can be a shrouded impeller having a non-axisymmetric profile for its hub and/or shroud.

20 Claims, 10 Drawing Sheets

(56) References Cited

U.S. PATENT DOCUMENTS

| | | | | |
|---|---|---|---|---|
| 6,695,579 | B2 | 2/2004 | Meng | |
| 7,191,519 | B2 * | 3/2007 | Roby | B22C 9/04 164/47 |
| 7,326,037 | B2 * | 2/2008 | Eslinger | F04D 29/2222 415/211.2 |
| 7,845,900 | B2 * | 12/2010 | Roduner | F01D 9/02 415/206 |
| 7,857,577 | B2 * | 12/2010 | Eslinger | F04D 29/688 416/235 |
| 8,371,811 | B2 | 2/2013 | Eslinger | |
| 9,163,642 | B2 * | 10/2015 | Masutani | F04D 29/281 |
| 9,951,787 | B2 * | 4/2018 | De Santis | F04D 29/284 |
| 2003/0235497 | A1 | 12/2003 | Meng | |
| 2006/0120866 | A1 * | 6/2006 | Kawabata | F04D 29/2216 415/206 |
| 2007/0116560 | A1 * | 5/2007 | Eslinger | F04D 13/10 415/206 |
| 2008/0199300 | A1 * | 8/2008 | Eslinger | F04D 13/10 415/58.2 |
| 2012/0100003 | A1 * | 4/2012 | Masutani | F04D 29/281 416/235 |
| 2015/0125302 | A1 * | 5/2015 | Roberto | F04D 17/00 416/183 |
| 2017/0152861 | A1 | 6/2017 | Japikse | |

* cited by examiner

NON-AXISYMMETRIC HUB AND SHROUD PROFILE FOR ELECTRIC SUBMERSIBLE PUMP STAGE

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 62/925,788, filed Oct. 25, 2019, the entirety of which is incorporated by reference herein and should be considered part of this specification.

BACKGROUND

Field

The present disclosure generally relates to electric submersible pump and other centrifugal pump stages having non-axisymmetric components and passage contours.

Description of the Related Art

Centrifugal pump stages of electrical submersible pumps (ESP) and other centrifugal pumps experience hydraulic losses due to so-called secondary flow patterns that develop within the stage. One example of a secondary flow is the development of vortices near boundaries of flow passages. Common causes of vortices and other secondary flows are Coriolis forces in impellers, and flow passage and blade curvature in impellers and diffusers. The secondary flow is commonly lower velocity than the core or primary flow, and often collects at the suction/hub corner in diffusers and at the pressure/shroud corner in impellers. Secondary flows are undesirable as they result in inefficient pump operation, surging, and in extreme cases, pump failure.

Flow passages in known diffusers and impellers are formed by hub and shroud blade contours that are surfaces of revolution about the stage axis. This makes the blade heights on the suction side and on the pressure side equal, or axisymmetric. Axisymmetric contours are the result of presently used stage analysis and design techniques and more importantly, current manufacturing techniques for making the corebox tooling.

SUMMARY

In some configurations, an electric submersible pump includes a plurality of stages, at least one of the plurality of stages comprising an impeller comprising a hub and a shroud, and a non-axisymmetric profile. The hub and/or the shroud can comprise the non-axisymmetric profile.

The hub and/or shroud can include the non-axisymmetric profile. The non-axisymmetric profile can extend less than 100% of a Meridional Length from a leading edge to a trailing edge of the impeller in a streamwise direction. The impeller can include a plurality of blades, each blade having a pressure side and a suction side, wherein the pressure side of the blade and the suction side of the blade have unequal heights. The impeller can include a plurality of circumferentially spaced blades, wherein the non-axisymmetric profile extends partially between adjacent blades in a blade-to-blade or circumferential direction. In some configurations, a Z-axis extends axially through the impeller and all surface normal vectors of the hub and shroud have positive Z-components. The impeller can be formed via sand casting. The stage(s) can further include a diffuser comprising a hub and a shroud. The hub and/or shroud of the diffuser can include a non-axisymmetric profile. The non-axisymmetric profile of the diffuser can extend less than 100% of a Meridional Length from a leading edge to a trailing edge of the diffuser in a streamwise direction.

In some configurations, an electric submersible pump (ESP) includes a plurality of stages, at least one of the plurality of stages comprising: an impeller; and a diffuser, at least one of the impeller and the diffuser comprising a non-axisymmetric profile, wherein a Z-axis extends axially through the stage and all surface normal vectors of the non-axisymmetric profile have positive Z-components.

The non-axisymmetric profile can extend less than 100% of a Meridional Length from a leading edge to a trailing edge of the impeller and/or the diffuser in a streamwise direction. The impeller and/or diffuser can include a plurality of circumferentially spaced blades, wherein the non-axisymmetric profile extends partially between adjacent blades in a blade-to-blade or circumferential direction. The impeller and/or diffuser can be formed via sand casting. The impeller and/or diffuser can include a plurality of blades, each blade having a pressure side and a suction side, wherein the pressure side and the suction side have unequal heights.

In some configurations, a method of manufacturing a stage for an electric submersible pump (ESP) includes providing tooling for forming an impeller or a diffuser having a non-axisymmetric profile; forming a sand core about the tooling; and removing the sand core from the tooling by pulling the sand core with a purely axial movement along a positive Z-axis.

The non-axisymmetric profile can be configured such that all surface normal vectors have positive Z-components. The non-axisymmetric profile can extend less than 100% of a Meridional Length from a leading edge to a trailing edge of the impeller or diffuser.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
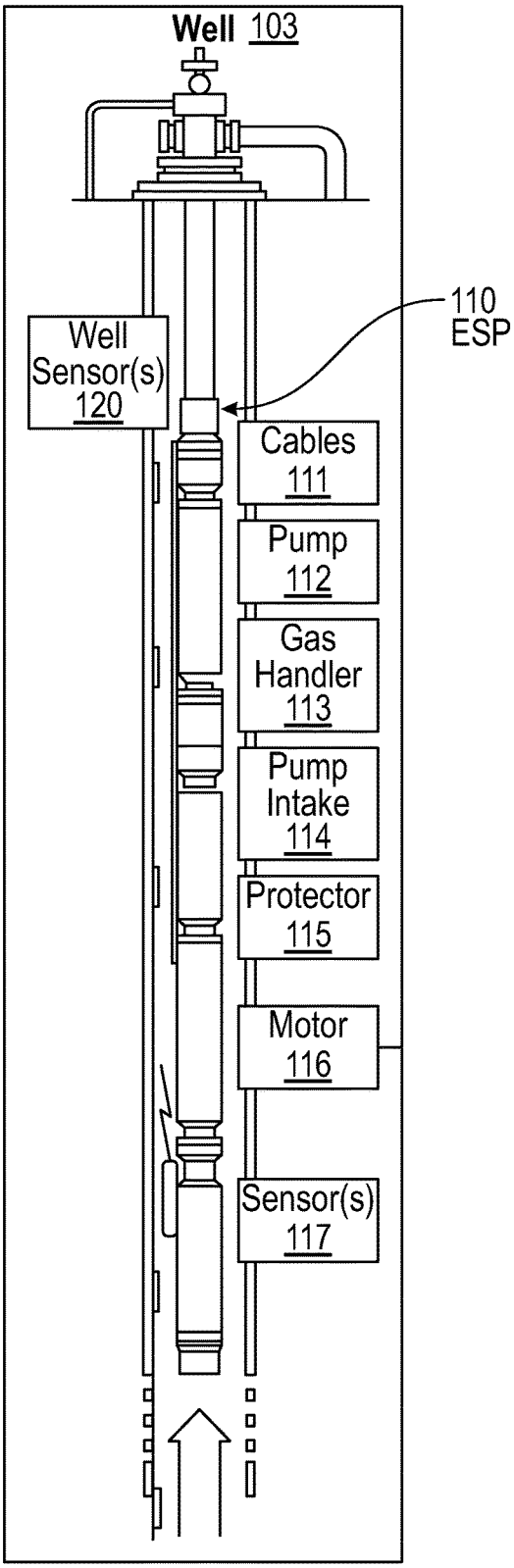
FIG. 1 shows a schematic of an electric submersible pump (ESP) system.

Various types of artificial lift equipment and methods are available, for example, electric submersible pumps (ESP). As shown in the example embodiment of FIG. 1, an ESP 110 typically includes a motor 116, a protector 115, a pump 112, a pump intake 114, and one or more cables 111, which can include an electric power cable. The motor 116 can be powered and controlled by a surface power supply and controller, respectively, via the cables 111. In some configurations, the ESP 110 also includes gas handling features 113 and/or one or more sensors 117 (e.g., for temperature, pressure, current leakage, vibration, etc.). As shown, the well 103 may include one or more well sensors 120.

Figure 2:
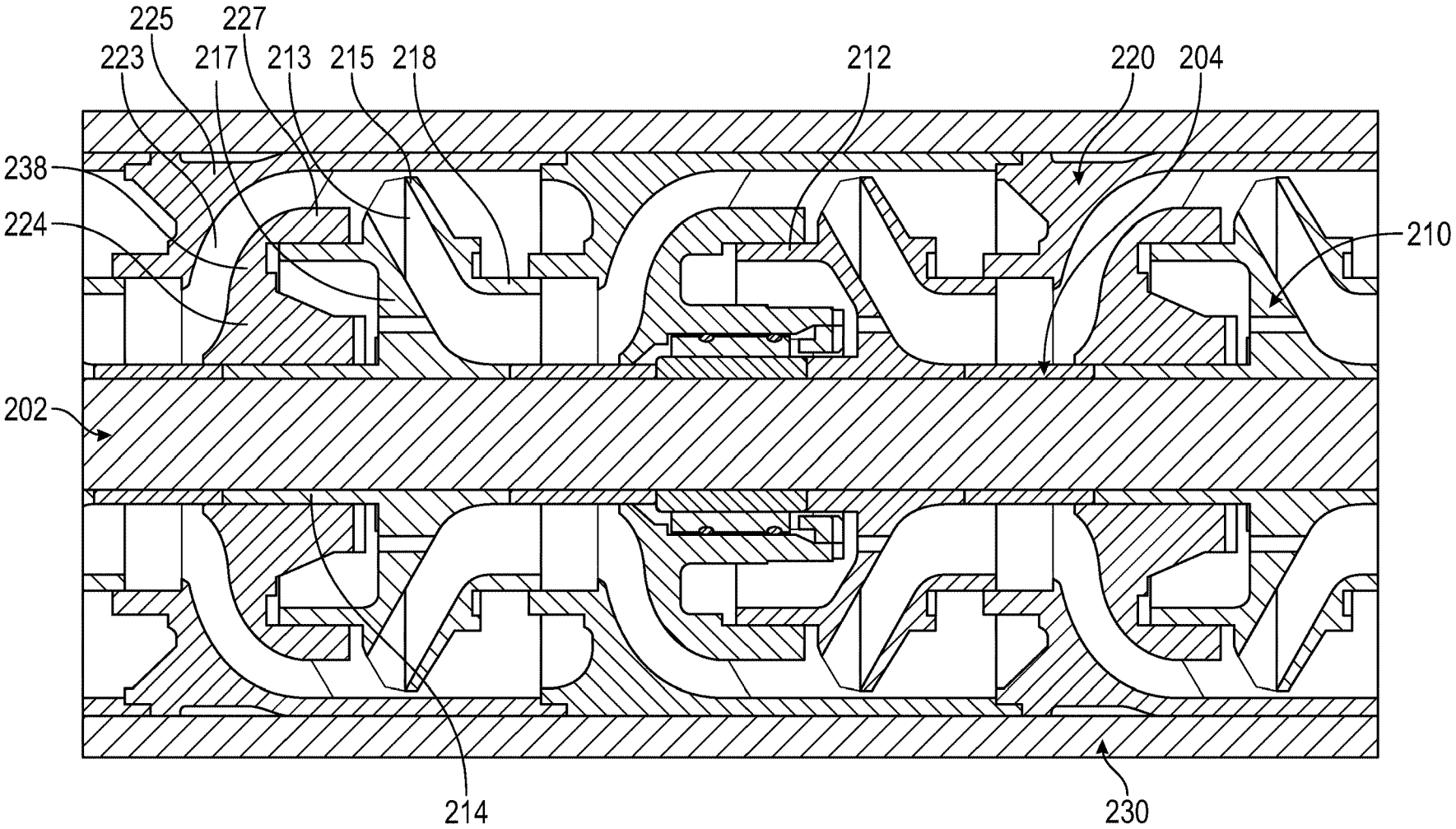
FIG. 2 shows a cross-section of a portion of a pump section of the ESP system of FIG. 1.

The pump 112 includes multiple centrifugal pump stages mounted in series within a housing 230, as shown in FIG. 2. Each stage includes a rotating impeller 210 and a stationary diffuser 220. One or more spacers 204 can be disposed axially between sequential impellers 210. A shaft 202 extends through the pump 112 (e.g., through central hubs or bores or the impellers 210 and diffusers 220) and is operatively coupled to the motor 116. The shaft 202 can be coupled to the protector 115 (e.g., a shaft of the protector), which in turn can be coupled to the motor 116 (e.g., a shaft of the motor). The impellers 210 are rotationally coupled, e.g., keyed, to the shaft 202. The diffusers 220 are coupled, e.g., rotationally fixed, to the housing 230. In use, the motor 116 causes rotation of the shaft 202 (for example, by rotating the protector 115 shaft, which rotates the pump shaft 202), which in turn rotates the impellers 210 relative to and within the stationary diffusers 220.

In use, well fluid flows into the first (lowest) stage of the pump 112 and passes through an impeller 210, which centrifuges the fluid radially outward such that the fluid gains energy in the form of velocity. Upon exiting the impeller 210, the fluid makes a sharp turn to enter a diffuser 220, where the fluid's velocity is converted to pressure. The fluid then enters the next impeller 210 and diffuser 220 stage to repeat the process. As the fluid passes through the pump stages, the fluid incrementally gains pressure until the fluid has sufficient energy to travel to the well surface.

As shown in FIG. 2, the impeller 210 includes a central hub 214, surrounding a bore through which the shaft 202 extends, and a skirt 218 radially or circumferentially surrounding a portion of the hub 214. A space between (e.g., radially between) the skirt 218 and hub 214 defines an intake or inlet of the impeller 210 and a portion of a flow path through the impeller 210. In the illustrated configuration, the impeller 210 includes an upper plate, disc, or shroud 217 and a lower plate, disc, or shroud 215. The upper shroud 217 extends radially outward from the hub 214. In some configurations, the upper shroud 217 can be considered part of the hub 214. Impeller blades or vanes 213 extend radially outward from the hub 214 and/or upper shroud 217. The lower shroud 215 extends radially outward from the skirt 218. The impeller blades 213 can extend between (e.g., axially between) the lower 215 and the upper shroud 217. The illustrated impeller 210 can therefore be considered a shrouded impeller. The hub 214, blades 213, lower shroud 215, and upper shroud 217 define fluid flow paths through the impeller 210. In conventional pumps, the diffuser 220 and impeller 210 typically have blades or vanes, e.g., impeller blades 213, and flow passages that are axisymmetric, and the blades typically have equal or consistent heights.

As also shown in FIG. 2, the diffuser 220 includes a central hub or bearing housing 224 through which the shaft 202 extends, a balance ring step 227, and an outer housing or shroud 225. The balance ring step 227 is radially spaced from and radially or circumferentially surrounds the bearing housing or central hub 224. A lower plate 238 extends between (radially between) and connects the balance ring step 227 and the bearing housing or central hub 224. The central hub or bearing housing 224, lower plate 238, and balance ring step 227 can together be considered or referred to as the hub of the diffuser. Diffuser blades or vanes 223 extend between the hub and the outer housing or shroud 225.

Centrifugal pump stages of electric submersible pumps (ESP) and other centrifugal pumps can experience hydraulic losses due to so-called secondary flow patterns that develop within the stage. An example of secondary flow is the development of vortices near boundaries of flow passages within or through the pump. Common causes of vortices and other secondary flows includes Coriolis forces in impellers and flow passage and blade curvature in impellers and diffusers. The secondary flow is often at a lower velocity than the core or primary flow, and often collects at the suction/hub corner in diffusers and at the pressure/shroud corner in impellers. Secondary flows are generally undesirable as they result in inefficient pump operation, surging, and in some cases, pump failure.

Impellers 210 and/or diffusers 220 according to the present disclosure have non-axisymmetric contours, thereby forming non-axisymmetric flow paths therethrough. The non-axisymmetric flow paths can help reduce or eliminate secondary flows and the problems associated therewith, such as recirculation losses at the downstream end of the flow paths. The non-axisymmetric contours or walls can be formed via conventional methods, for example, sand core (pre-forming the profile) or investment casting, or non-conventional methods, for example, 3D sand core printing or 3D metal printing, and/or secondary post processing.

In an impeller 210, the non-axisymmetric contour(s) can be on the hub 214 (and/or upper shroud 217) and/or shroud (e.g., lower shroud 215) side of the blades 213. For example, the non-axisymmetric contour(s) can be formed in or on an inner (hub, blade 213, and/or flow passage facing) surface of the lower shroud 215 and/or an outer (lower shroud 215, blade 213, and/or flow passage facing) surface of the hub 214 (and/or upper shroud 217). In a diffuser 220, the non-axisymmetric contour(s) can be in or on an outer (blade 223 or flow passage facing) surface of the hub (e.g., including the hub or bearing housing 224, lower plate 238, and/or balance ring step 227) and/or in or on an inner (blade 223 or flow passage facing) surface of the outer housing or shroud 225.

The non-axisymmetric contour(s) can extend, partially or fully, from a pressure side 253 (shown in FIG. 4) to a suction side 243 (shown in FIG. 4) of the blades (impeller blades 213 and/or diffuser blades 223) in a blade-to-blade direction and/or from the leading edge LE (e.g., of the blades) towards the trailing edge TE in a streamwise direction. In other words, the extent of the non-axisymmetric profile or contour (s) does not have to be entirely from blade to blade or from leading edge to trailing edge, and only a portion of the impeller 210 or diffuser 220 may have a non-axisymmetric profile. The non-axisymmetric contour(s) can form a horizontal S shape. In some configurations, a blade height hs on the suction side 243 of the blade 213, 223 can be different than a blade height hp on the pressure side 253 of the blade 213, 223. For example, the suction side 243 blade height hs can be greater than the pressure side 253 blade height hp, or the suction side 243 blade height hs can be less than the pressure side 253 blade height hp. Some non-axisymmetric configurations "squeeze" the flow on the low pressure side of the blades, thereby retarding the accumulation of low momentum fluid and mitigating flow separation and recirculation losses.

Figure 3:
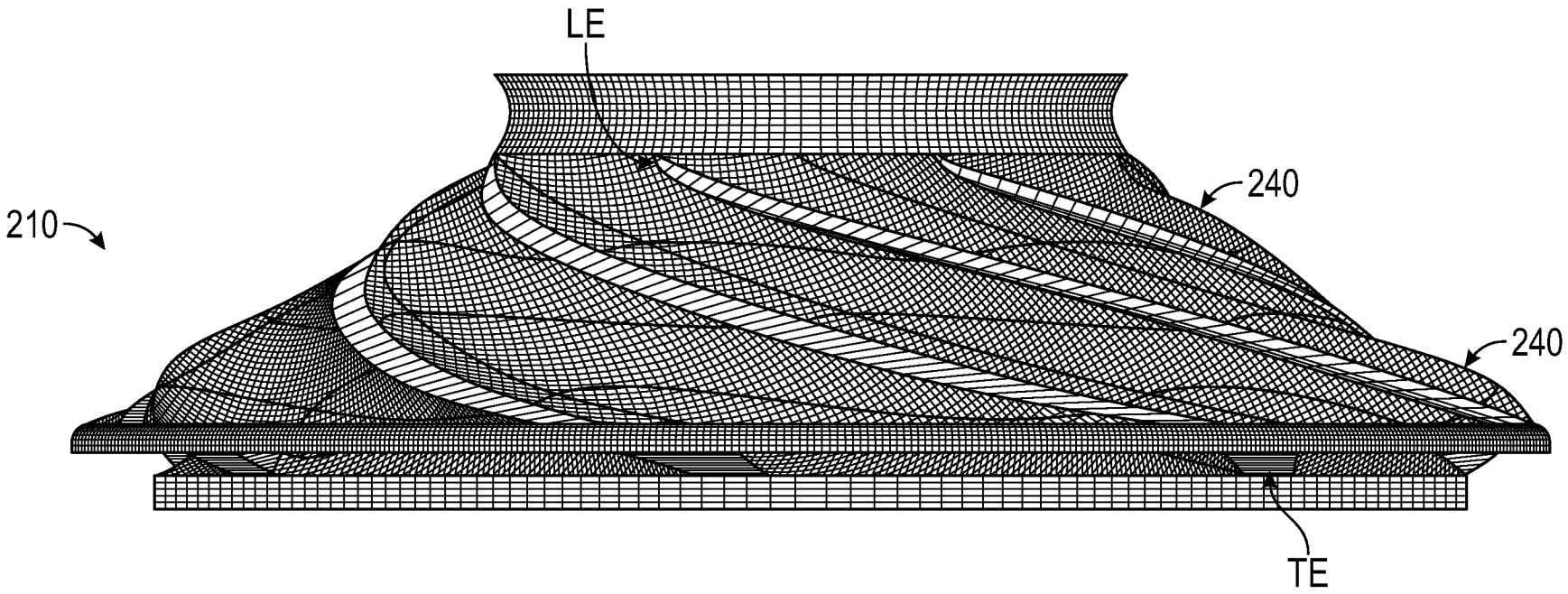
FIG. 3 shows an impeller having a non-axisymmetric profile on the shroud surface.
Figure 4:
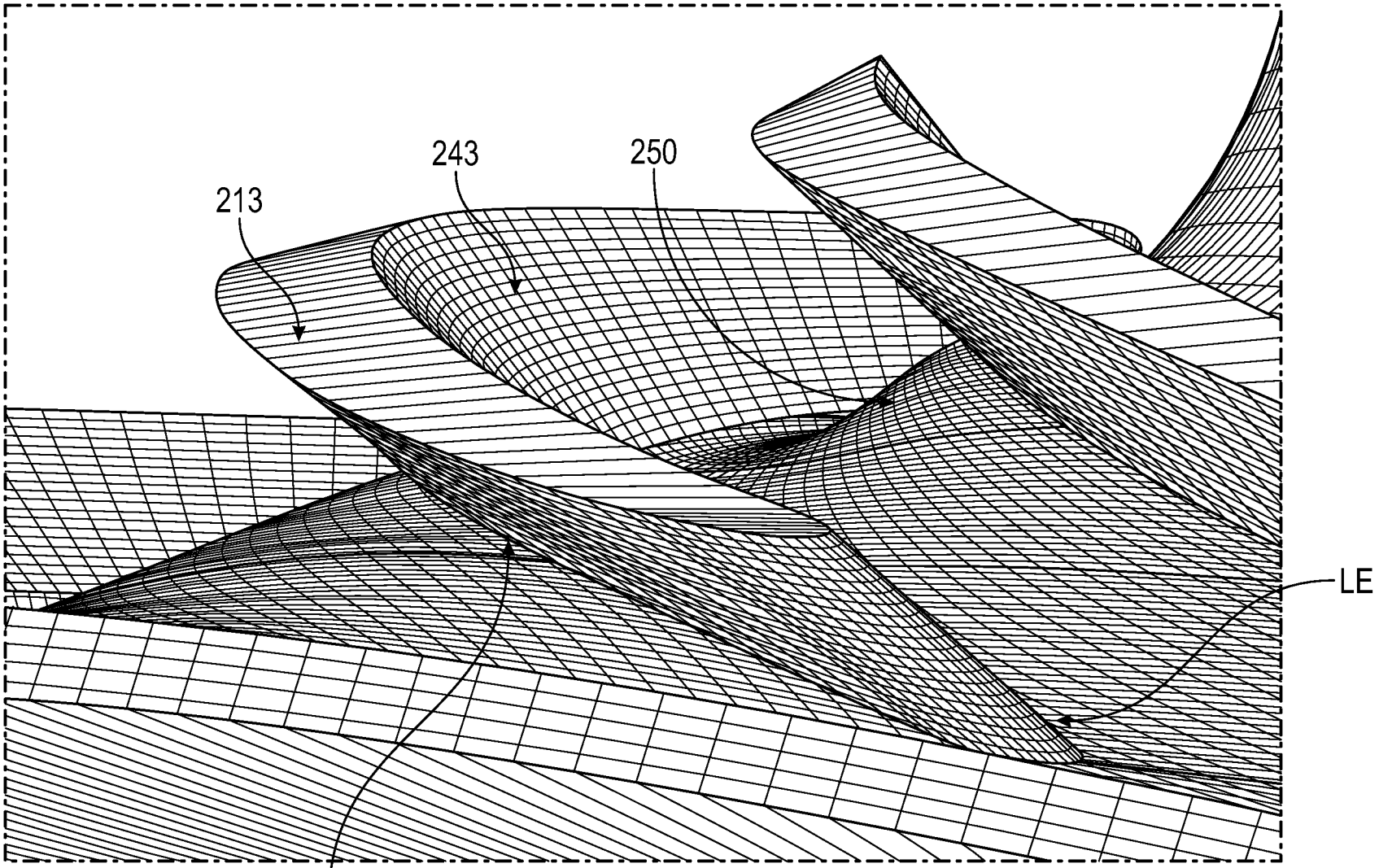
FIG. 4 shows an impeller hub side having a non-axisymmetric end wall contour.

FIG. 3 shows an impeller 210 having a non-axisymmetric end wall contour on both the hub and shroud sides (however the hub side is hidden in the view of FIG. 3; while the non-axisymmetric contour 240 on the shroud 215 is shown). In some configurations, the non-axisymmetric contour can have an extended range from 0 to 100% Meridional Length from the leading LE to the trailing edge TE or the exit duct. In other configurations, only a portion (i.e., less than 100%) of the Meridional Length from the leading to the trailing edge may be non-axisymmetric. The non-axisymmetric contour can have non-equal spacing, width, length, and/or height and/or can have an undulating profile spanning from blade to blade. FIG. 4 shows a similar non-axisymmetric end wall contour 250 on the hub side of the impeller 210. As also shown in FIG. 4, the wall on the pressure side 253 of the blade 213 can be higher than the wall on the suction side 243 of the blade 213.

Figure 5:
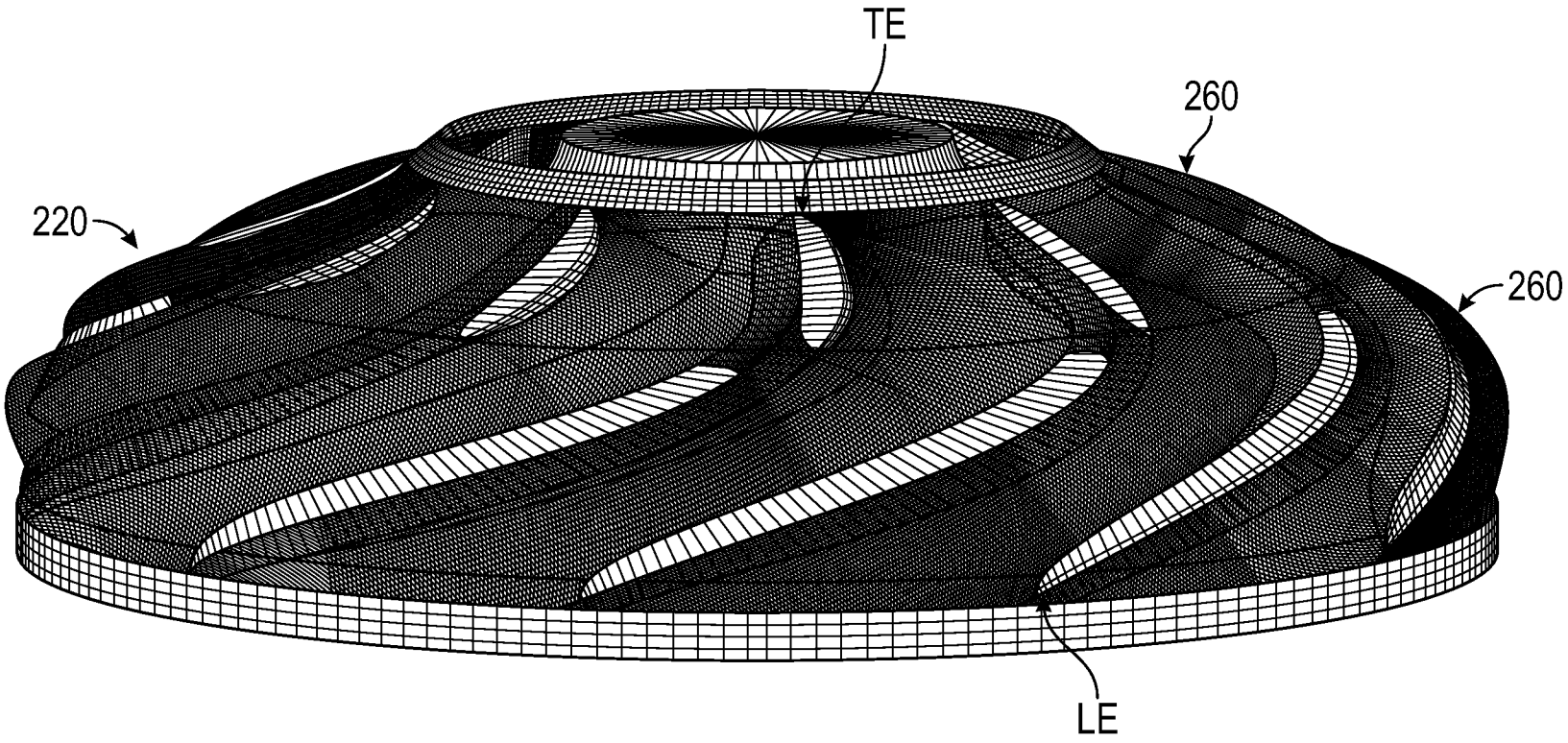
FIG. 5 shows a diffuser having a non-axisymmetric end wall contour on the shroud side.
Figure 6:
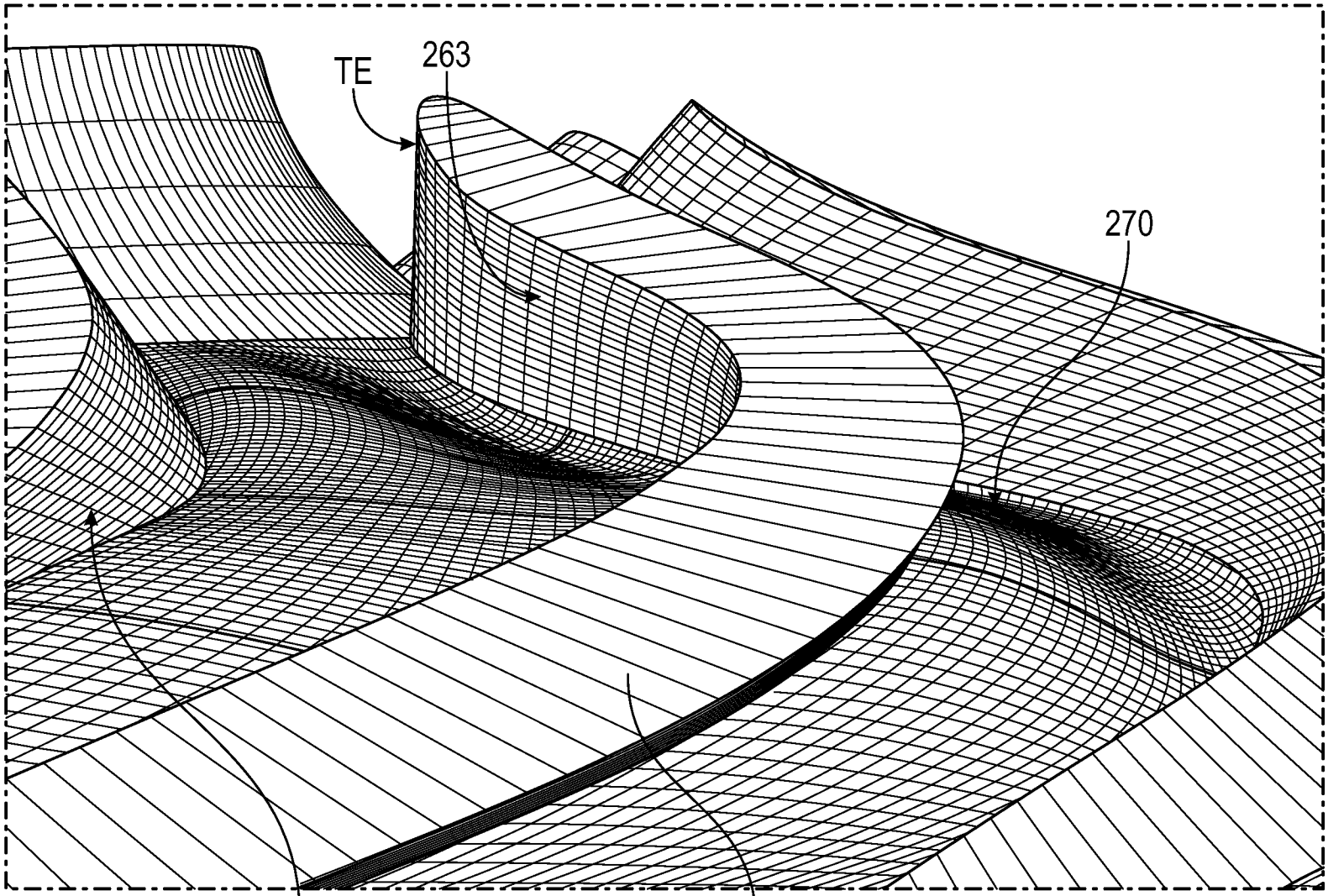
FIG. 6 shows a diffuser having a non-axisymmetric end wall contour on the shroud side.

FIG. 5 shows a diffuser 220 having non-axisymmetric end wall designs or contours on both the hub and outer housing or shroud 225 sides (however, the hub side is hidden in the view of FIG. 5, while the non-axisymmetric contour 260 on the shroud 225 is shown). The non-axisymmetric contour can extend fully or partially from the diffuser inlet or leading edge LE to the diffuser exit or trailing edge TE. The non-axisymmetric contour can have non-equal spacing, width, length, and/or height and/or can have an undulating profile spanning from blade to blade. FIG. 6 shows a similar non-axisymmetric end wall contour 270 on the hub side of the diffuser 220. In the illustrated configuration, the wall on the pressure side 273 of the diffuser blade 223 is higher than the wall on the suction side 263 of the diffuser blade 223.

Figure 10:
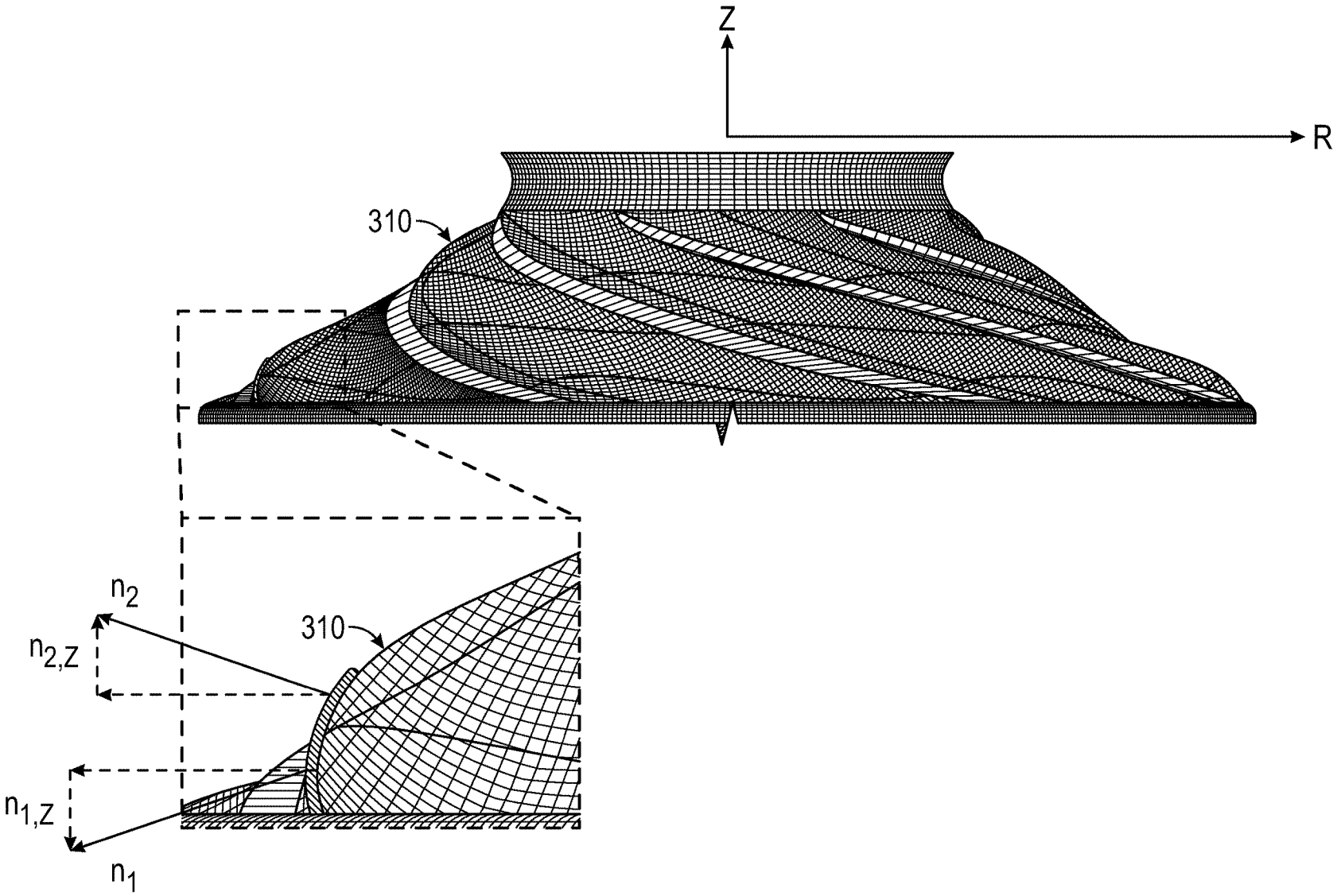
FIG. 10 shows an enlarged portion of the impeller of FIG. 3 showing details of the non-axisymmetric contour.

Impellers 210 and/or diffusers 220 having one or more non-axisymmetric contours can be manufactured via a sand casting process. FIG. 10 shows surfaces of tooling 310 (e.g., metal tooling) used in the sand casting process. To create the sand core, sand is blown into a space above or about the tooling 310. Once the core has cured, the core must be removed from the tooling 310. In some configurations, a Z-component of all surface normal vectors of the non-axisymmetric profile of the shroud and/or hub, and therefore the corresponding surfaces of the tooling 310, is positive. The Z-component extends parallel to a Z-axis extending axially through the impeller 210 and/or diffuser 220, as defined and labeled in FIG. 10. When assembled in a pump, the Z-axis extends along or is aligned with the shaft 202. FIG. 10 illustrates a surface normal vector $n_2$ having a positive Z-component $n_{2,z}$, and a surface normal vector $n_1$ having a negative Z-component $n_{1,z}$.

Configurations having positive Z-components of the surface normal vectors advantageously allow the sand core to be retracted from the tooling 310 of the hub and/or shroud during manufacturing by pulling the core axially (e.g., with a purely axial movement along the positive Z-axis, as labeled in FIG. 10). The non-axisymmetric contour at $n_2$ as shown in FIG. 10 is therefore axially retractable, while the contour at $n_1$ is locking during axial retraction from the tooling 310. In some configurations, a non-axisymmetric contour extending less than 100% of the Meridional Length of an impeller 210 and/or diffuser 220 (in other words, the non-axisymmetric contour does not extend fully from the leading edge to the trailing edge) can help create a contour in which all surface normal vectors have a positive Z-component. In some such configurations, the non-axisymmetric profile does not extend to the leading edge.

Figure 7:
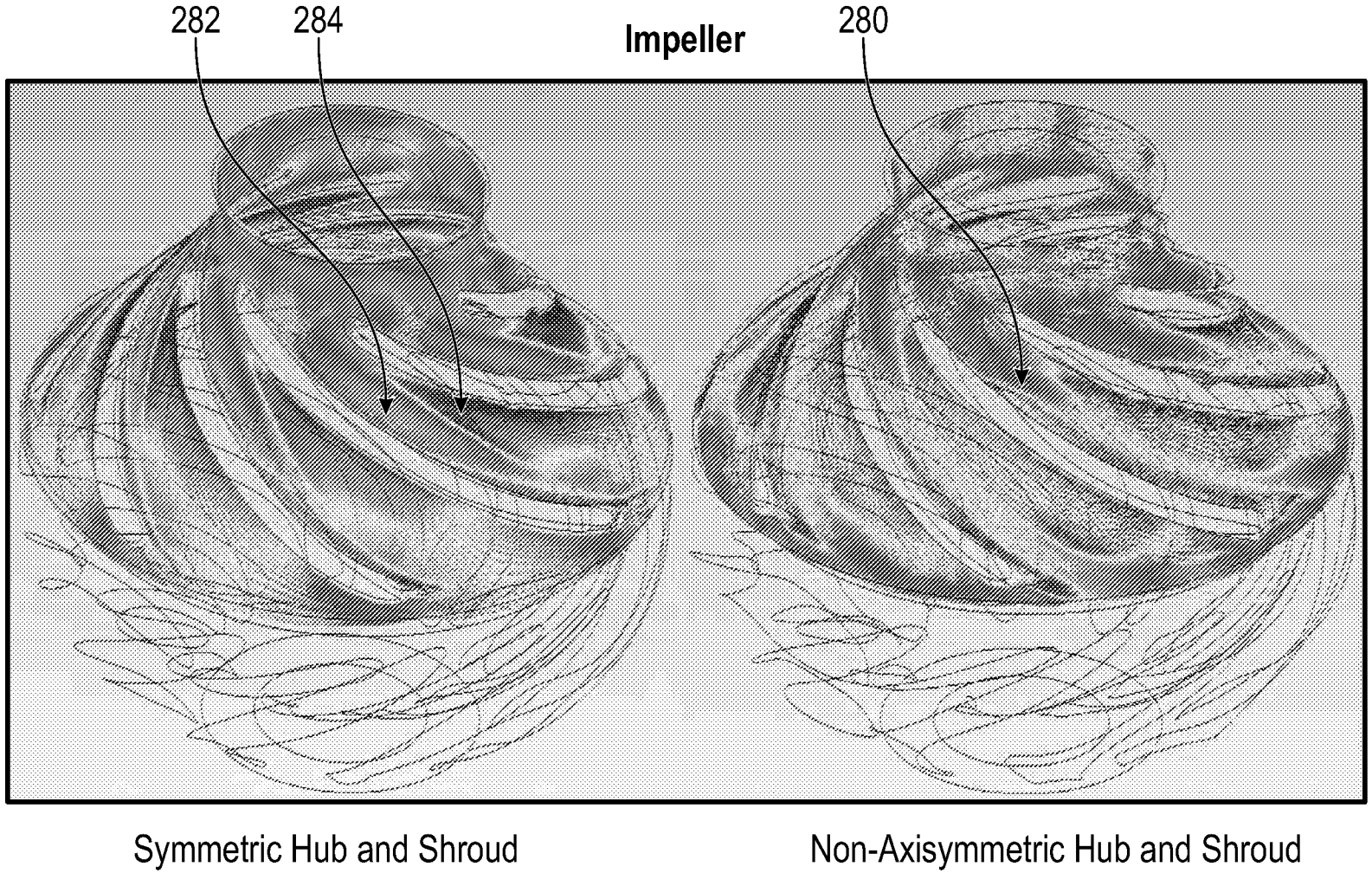
FIG. 7 shows a velocity vector comparison of a symmetric impeller and a non-axisymmetric profile impeller.

FIG. 7 shows plots of performance of an impeller having a symmetric hub and shroud profile on the left compared to an impeller 210 having a non-axisymmetric hub and shroud profile on the right, showing the improved effectiveness of the non-axisymmetric design. As shown, in a blade to blade direction, close to the shroud surface, the velocity profile 280 of the non-axisymmetric end wall is more uniform (e.g., from upstream to downstream) compared to a conventional design. Whereas the conventional design has more and higher velocity regions 282 on the suction side 243 of the vanes and more and larger low velocity recirculation regions 284 on the suction side 243 downstream, the non-axisymmetric design has a more uniformly distributed flow field and zones 280. The non-axisymmetric design therefore has less high velocity contrast or shear regions such that hydraulic losses are lessened.

Figure 8:
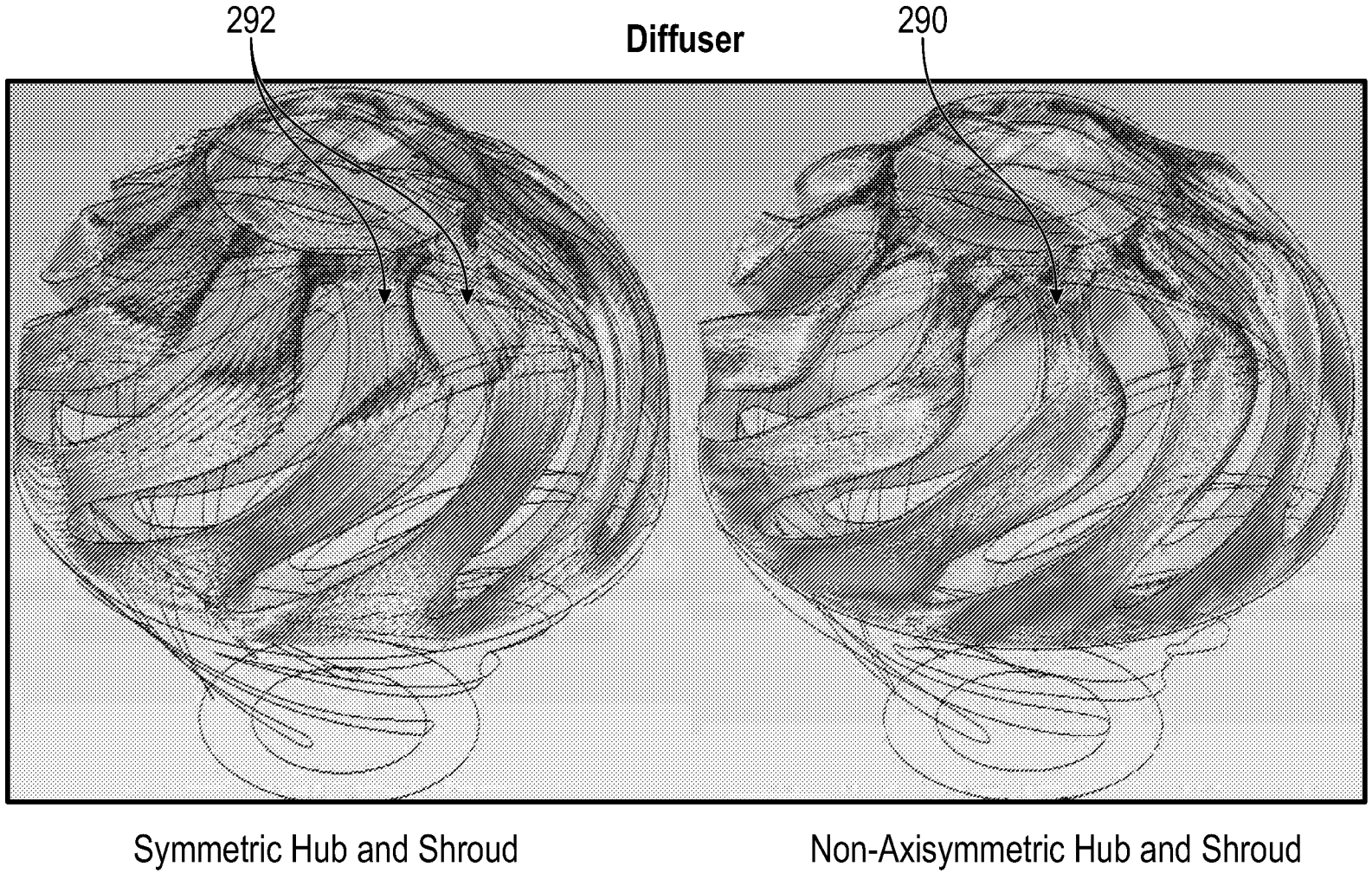
FIG. 8 shows a velocity vector comparison of a symmetric diffuser and a non-axisymmetric profile diffuser.

Similarly, FIG. 8 shows plots of performance of a diffuser having a symmetric hub and shroud profile on the left compared to a diffuser 220 having a non-axisymmetric hub and shroud profile on the right, showing the improved effectiveness of the non-axisymmetric design. As shown, close to the shroud surface, the velocity profile 290 of the non-axisymmetric end wall is more uniform compared to a conventional symmetric design, which has low velocity recirculation 292 at or near the diffuser exit. The non-axisymmetric design has less high velocity contrast or shear regions such that hydraulic losses are lessened. The non-axisymmetric contour suppresses secondary flow regions.

Figure 9:
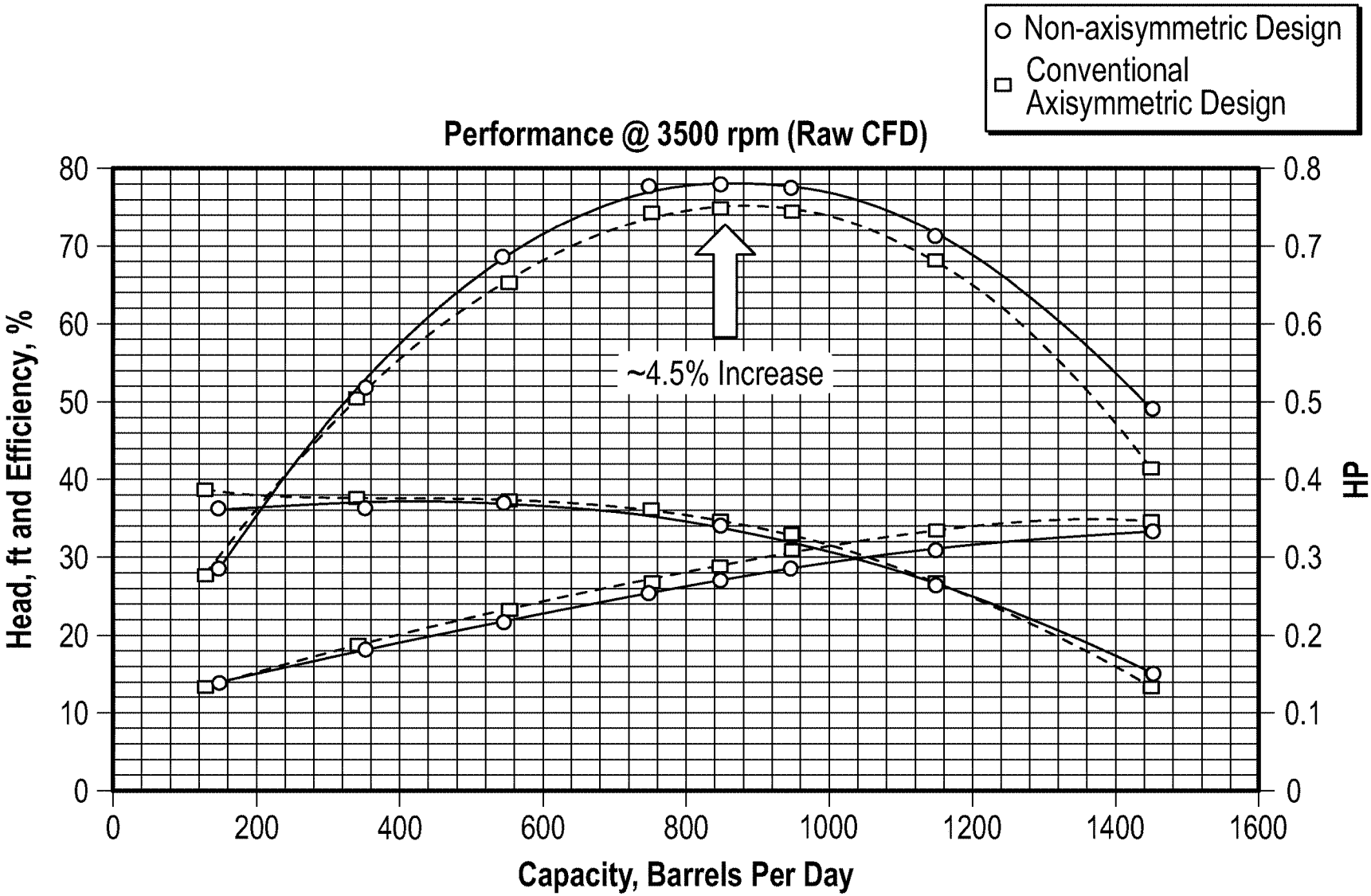
FIG. 9 shows a CFD performance comparison of standard and non-axisymmetric stage designs.

FIG. 9 illustrates comparisons of CFD results for the non-axisymmetric design compared to the conventional axisymmetric design. As shown, the non-axisymmetric design increases the efficiency of the stage by approximately 4.5% compared to an automatically optimized baseline stage having a conventional axisymmetric design.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. An electric submersible pump (ESP) comprising a plurality of stages, at least one of the plurality of stages comprising:

an impeller comprising a first hub, a first shroud; and a blade including a pressure side and a suction side, wherein a height of the pressure side of the blade is different than a height of the suction side of the blade; and a first non-axisymmetric profile; wherein the first non-axisymmetric profile extends less than 100% of a Meridional Length from a leading edge to a trailing edge of the blade in a streamwise direction.

2. The ESP of claim 1, wherein the first hub comprises the first non-axisymmetric profile.

3. The ESP of claim 1, wherein the first shroud comprises the first non-axisymmetric profile.

4. The ESP of claim 1, wherein the first hub and the first shroud each comprise the first non-axisymmetric profile.

5. The ESP of claim 1, wherein the blade is a first blade, and the ESP further comprises:

a second blade, wherein the first and second blades are circumferentially spaced and wherein the first non-axisymmetric profile extends partially between adjacent blades in a blade-to-blade or circumferential direction.

6. The ESP of claim 1, wherein a Z-axis extends axially through the impeller and all surface normal vectors of the first hub and the first shroud have positive Z-components.

7. The ESP of claim 1, the at least one of the plurality of stages further comprising a diffuser comprising a second hub and a second shroud.

8. The ESP of claim 7, wherein the diffuser comprises a second non-axisymmetric profile on the second hub and/or the second shroud.

9. The ESP of claim 8, wherein the second non-axisymmetric profile of the diffuser extends less than 100% of a Meridional Length from a leading edge to a trailing edge of the diffuser in a streamwise direction.

10. The ESP of claim 1, wherein the height of the pressure side of the blade is less than the height of the suction side of the blade.

11. The ESP of claim 1, wherein a Z-aXis extends axially through the impeller and the first non-axisymmetric profile includes at least one surface normal vector including a positive Z-component and at least one surface normal vector including a negative Z-component.

12. The ESP of claim 1, wherein the height of the pressure side of the blade is greater than the height of the suction side of the blade.

13. An electric submersible pump (ESP) comprising a plurality of stages, at least one of the plurality of stages comprising:

an impeller; and a diffuser, at least one of the impeller and the diffuser comprising a non-axisymmetric profile, wherein a Z-axis extends axially through the stage and the non-axisymmetric profile includes at least one surface normal vector including a positive Z-component and at least one surface normal vector including a negative Z-component.

14. The ESP of claim 13, wherein:

at least one of the impeller or the diffuser comprising a blade including a pressure side and a suction side, wherein a height of the pressure side of the blade is different than a height of the suction side of the blade; and wherein the non-axisymmetric profile extends less than 100% of a Meridional Length from a leading edge to a trailing edge of the blade in a streamwise direction.

15. The ESP of claim 14, wherein the height of the pressure side of the blade is less than the height of the suction side of the blade.

16. The ESP of claim 14, wherein the blade is a first blade, and the ESP further comprises:

a second blade, wherein the first and second blades are circumferentially spaced and wherein the non-axisymmetric profile extends partially between the first and second blades in a blade-to-blade or circumferential direction.

17. A method of manufacturing a stage for an electric submersible pump (ESP), the method comprising:

providing tooling for forming an impeller or a diffuser, the impeller or the diffuser comprising:

a blade including a pressure side and a suction side, wherein a height of the pressure side of the blade is different than a height of the suction side of the blade; and a non-axisymmetric profile, wherein the non-axisymmetric profile extends less than 100% of a Meridional Length from a leading edge to a trailing edge of the blade in a streamwise direction;

forming a sand core about the tooling; and removing the sand core from the tooling by pulling the sand core with a purely axial movement along a positive Z-axis.

18. The method of claim 17, wherein the non-axisymmetric profile is configured such that all surface normal vectors have positive Z-components.

19. The method of claim 17, wherein the height of the pressure side of the blade is less than the height of the suction side of the blade.

20. The method of claim 17, wherein the height of the pressure side of the blade is greater than the height of the suction side of the blade.

* * * * *